US008651885B2

(12) United States Patent
Ashibu

(10) Patent No.: US 8,651,885 B2
(45) **Date of Patent: *Feb. 18, 2014**

(54) BOARD CONNECTOR

(75) Inventor: Kenta Ashibu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 60 days.

This patent is subject to a terminal disclaimer.

(21) Appl. No.: 13/526,854

(22) Filed: Jun. 19, 2012

(65) Prior Publication Data

US 2013/0036577 A1 Feb. 14, 2013

(30) Foreign Application Priority Data

Aug. 10, 2011 (JP) ..... 2011-175126

(51) Int. Cl.
*H01R 12/24* (2006.01)

(52) U.S. Cl.
USPC ..... 439/328

(58) Field of Classification Search
USPC ..... 439/260–264, 492–495, 635, 372, 325, 439/328
See application file for complete search history.

(56) References Cited

U.S. PATENT DOCUMENTS

| | | | | |
|---|---|---|---|---|
| 3,710,303 | A * | 1/1973 | Gallager, Jr. | 439/593 |
| 3,858,957 | A * | 1/1975 | Harwood et al. | 439/59 |
| 4,747,794 | A * | 5/1988 | Seidler | 439/857 |
| 5,402,316 | A * | 3/1995 | Volz et al. | 361/785 |
| 6,431,897 | B1 * | 8/2002 | Hashiguchi et al. | 439/267 |
| 7,270,567 | B2 * | 9/2007 | Inoue | 439/495 |
| 7,422,472 | B2 * | 9/2008 | Hashiguchi et al. | 439/495 |
| 8,075,328 | B2 * | 12/2011 | Ashibu | 439/260 |
| 8,145,261 | B2 * | 3/2012 | Wang et al. | 455/550.1 |
| 8,292,648 | B2 * | 10/2012 | Kiryu et al. | 439/328 |
| 8,298,001 | B2 * | 10/2012 | Ashibu et al. | 439/495 |
| 8,444,427 | B2 * | 5/2013 | Hashimoto | 439/325 |
| 2007/0066127 | A1 | 3/2007 | Inoue | |
| 2008/0050958 | A1 | 2/2008 | Hashiguchi et al. | |
| 2008/0050966 | A1 | 2/2008 | Hashiguchi et al. | |
| 2011/0244709 | A1 | 10/2011 | Ashibu | |

FOREIGN PATENT DOCUMENTS

| | | | |
|---|---|---|---|
| JP | 2002-270292 | A | 9/2002 |
| JP | 2004-039479 | A | 2/2004 |
| JP | 2006-351288 | A | 12/2006 |
| JP | 2010-061927 | A | 3/2010 |
| JP | 2010-225448 | | 10/2010 |

OTHER PUBLICATIONS

English translation of relevant parts of Japanese Office Action dated Dec. 15, 2010 in Japanese Application No. 2010-235684.

(Continued)

*Primary Examiner* — Neil Abrams
*Assistant Examiner* — Phuongchi T Nguyen
(74) *Attorney, Agent, or Firm* — Collard & Roe, P.C.

(57) ABSTRACT

A board connector comprising: a contact comprising a first and a second clipping portion and for clipping therebetween a board which is inserted from the outside, a first beam portion supporting the first clipping portion, and a second beam portion supporting the second clipping portion; a housing that supports the contact; and an actuator that is fixed to the first beam portion, wherein the actuator has an action point portion that is formed more on a rear side in a board insertion direction than the first and second clipping portions and and that is pushed by the board at the time of insertion of the board, and the first clipping portion is elastically displaceable independently of the actuator in a direction away from the second clipping portion.

13 Claims, 9 Drawing Sheets

(56) References Cited

OTHER PUBLICATIONS

English translation of relevant parts of Japanese Office Action dated Apr. 27, 2011 in Japanese Application No. 2010-235684.
Korean Office Action dated Jun. 26, 2013 in Korean Application No. 2012-0076736 with English translation.

* cited by examiner

BOARD CONNECTOR

This application is based upon and claims the benefit of priority from Japanese patent application No. 2011-175126, filed on Aug. 10, 2011, the disclosure of which is incorporated herein in its entirety by reference.

TECHNICAL FIELD

This invention relates to a connector and, in particular, relates to a board connector for connection between a plate-like connection object such as FPC (Flexible Printed Circuit) or FFC (Flexible Flat Cable) and another connection object.

BACKGROUND ART

As shown in FIG. 9, there is known an electrical connector 500 comprising contacts 530 each having a movable beam 531 and a stationary beam 532, an insulating housing 510 to which the stationary beams 532 are fixed, and an actuator 520 having a shaft member 525 which is rotatably supported by intermediate portions between the movable beams 531 and the stationary beams 532 of the contacts 530 (see, e.g. Patent Document 1: JP-A-2010-225448).

The actuator 520 has guide-locking portions 522 adapted to be pushed by a board T1 at the time of board insertion and an open-engaging portion 526 adapted to engage with front end portions of the movable beams 531. Each movable beam 531 has a terminal contact convex portion 531 a adapted to serve as a contact point with the board T1.

This conventional electrical connector 500 is configured such that, at the time of board insertion, the guide-locking portions 522 of the actuator 520 are pushed to move upward by the board T1 and that, following this, the actuator 520 pivots on the shaft member 525 to cause the open-engaging portion 526 to engage and raise the movable beams 531.

SUMMARY OF THE INVENTION

However, the conventional electrical connector 500 has a problem that since the actuator 520 and the movable beams 531 that make different movements are linked together by the engagement between the open-engaging portion 526 and the movable beams 531, if a manufacturing or assembly error or the like occurs, the movements of the actuator 520 and the movable beams 531 are subjected to variation and, as a consequence, the accurate linking movements tend to be spoiled.

Further, the conventional electrical connector 500 has a problem that failure tends to occur in the linkage mechanism due to damage, deformation, disengagement, or the like at the pivotal support portions of the actuator 520 or at the engaging portions between the actuator 520 and the movable beams 531.

If the accurate linkage between the actuator 520 and the movable beams 531 is degraded, there arises a problem that the distance between the movable beams 531 adapted to be raised by the insertion of the board T1 and the stationary beams 532 is subjected to variation, thereby impairing the contact reliability between the electrical connector 500 and the board T1 or damaging the board T1 due to sliding between the contacts 530 and the board T1.

Further, the conventional electrical connector 500 has a problem that since the terminal contact convex portions 531 a adapted to serve as contact points with the board T1 are fixedly formed in the movable beams 531, when the board T1 has variation in thickness, the terminal contact convex portions 531*a* excessively slide on the board T1 to damage the board T1 or, conversely, the terminal contact convex portions 531*a* are not sufficiently brought into contact with the board T1, thereby impairing the contact reliability between the electrical connector 500 and the board T1.

This invention is intended to solve the above-mentioned conventional problems, that is, it is an object of this invention to provide a board connector that can prevent the occurrence of failure in linking function and that can achieve improvement in contact reliability and prevention of damage to a board.

According to an exemplary aspect of the present invention, there is provided a board connector comprising: a contact comprising a first and a second clipping portion for clipping therebetween a board which is inserted from the outside, a first beam portion supporting the first clipping portion, and a second beam portion supporting the second clipping portion; a housing that supports the contact; and an actuator that is fixed to the first beam portion, wherein the actuator has an action point portion (pressed portion) that is formed more on a rear side in a board insertion direction than the first and second clipping portions and that is pushed by the board at the time of insertion of the board, and the first clipping portion is elastically displaceable independently of the actuator in a direction away from the second clipping portion.

The second beam portion may be held by the housing, and the second clipping portion may be elastically displaceable independently of the housing in a direction away from the first clipping portion.

According to an exemplary other aspect of the present invention, there is provided a board connector comprising: a contact comprising a first and a second clipping portion for clipping therebetween a board which is inserted from the outside, a first beam portion supporting the first clipping portion, and a second beam portion supporting the second clipping portion; a housing that supports the second beam portion; and an actuator that is fixed to the first beam portion, wherein the actuator has an action point portion that is formed more on a rear side in a board insertion direction than the first and second clipping portions and that is pushed by the board at the time of insertion of the board, and the second clipping portion is elastically displaceable independently of the housing in a direction away from the first clipping portion.

The first clipping portion may be elastically displaceable independently of the first beam portion.

The first clipping portion may be supported like a cantilever by the first beam portion.

The first beam portion may have a fixed portion which is formed more on a front side in the board insertion direction than the first clipping portion and is fixed to the actuator.

The first beam portion may have an abutting portion which is formed more on the rear side in the board insertion direction than the first clipping portion and whose movement toward the second clipping portion side is regulated by abutment against a to-be-abutted portion of the actuator.

The second clipping portion may be elastically displaceable independently of the second beam portion.

The second clipping portion may be supported like a cantilever by the second beam portion.

The second beam portion may have a fixed portion which is formed more on a front side in the board insertion direction than the second clipping portion and is fixed to the housing.

The second beam portion may have an abutting portion which is formed more on the rear side in the board insertion direction than the second clipping portion and whose movement toward the first clipping portion side is regulated by abutment against a to-be-abutted portion of the housing.

The contact may have a connecting portion that connects between the first beam portion and the second beam portion.

A plurality of contacts may be provided and are arranged in parallel with each other in a direction perpendicular to the board insertion direction.

EFFECT OF THE INVENTION

According to this invention, as a linkage mechanism for linking between pushed movement of an action point portion of an actuator due to insertion of a board and an increase in distance between a first and a second clipping portion of a contact, use is made of a simple structure in which the actuator and a first beam portion of the contact are fixed together. Accordingly, it is possible to suppress the occurrence of operation failure of a board connector due to failure of the linkage mechanism.

Since the actuator and the first beam portion of the contact are fixed together, it is possible to maintain accurate linkage between the actuator and the first beam portion. Accordingly, the distance between the first and second clipping portions which increases by the insertion of the board can be maintained constant. Therefore, it is possible to avoid sliding between the board and the first and second clipping portions to reliably prevent damage to the board and it is also possible to improve the contact reliability between the board connector and the board.

Since at least one of the first and second clipping portions has elasticity which is independent of the actuator or a housing, even if variation exists, for example, in the thickness of the board inserted into the board connector, such variation can be absorbed by the elasticity of at least one of the first and second clipping portions. As a consequence, it is possible to prevent damage to the board due to excessive sliding contact between the first and second clipping portions and the board or to prevent degradation of the contact reliability between the board connector and the board due to insufficient contact between the first and second clipping portions and the board.

EXEMPLARY EMBODIMENT

Hereinbelow, board connectors according to embodiments of this invention will be described with reference to the drawings.

First Embodiment

Figure 1:
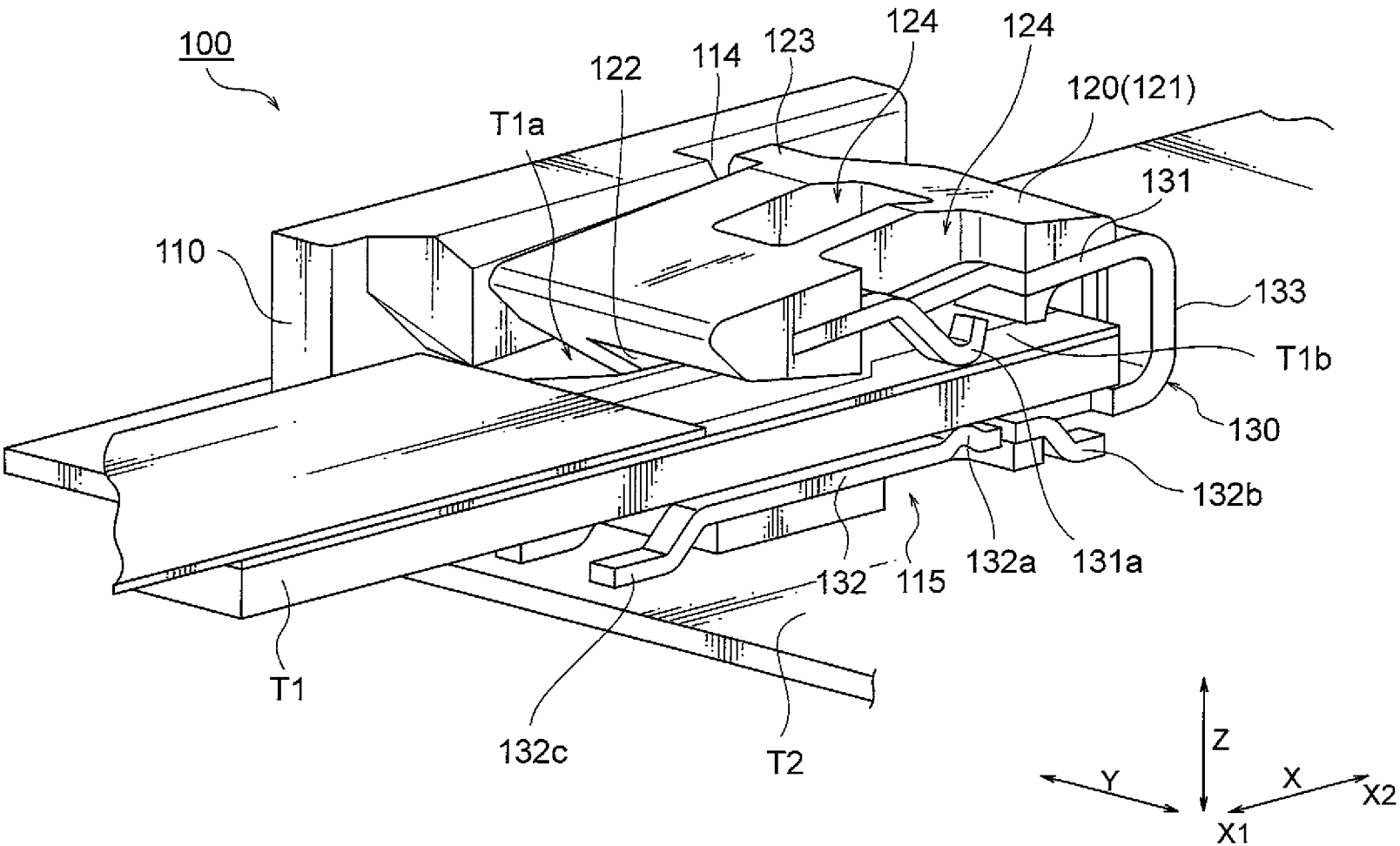
FIG. 1 is a perspective view, partly broken away, showing a board connector according to a first embodiment of this invention.

As shown in FIG. 1, a board connector 100 according to a first embodiment of this invention is used for connection between a first board (FPC, Flexible Printed Circuit) T1 adapted to be inserted into the board connector 100 from the outside and a second board (printed board) T2 mounting thereon the board connector 100.

Figure 2:
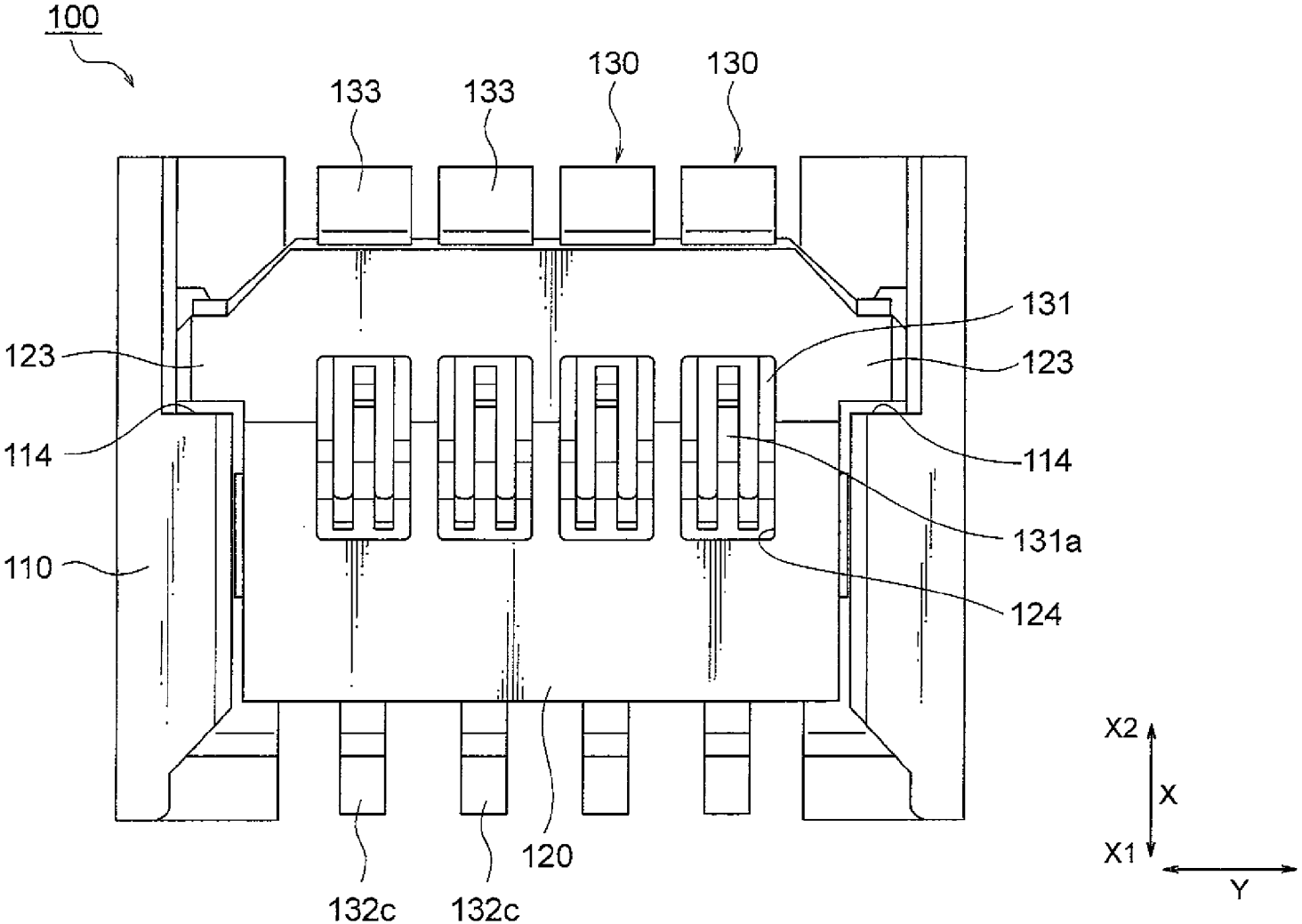
FIG. 2 is a top view, as seen from the actuator side, showing the board connector.

As shown in FIGS. 1 and 2, the board connector 100 comprises a housing 110, an actuator 120, and a plurality of contacts 130. The housing 110 and the actuator 120 are formed of an insulating resin, while the contacts 130 are formed of a copper alloy.

Figure 4:
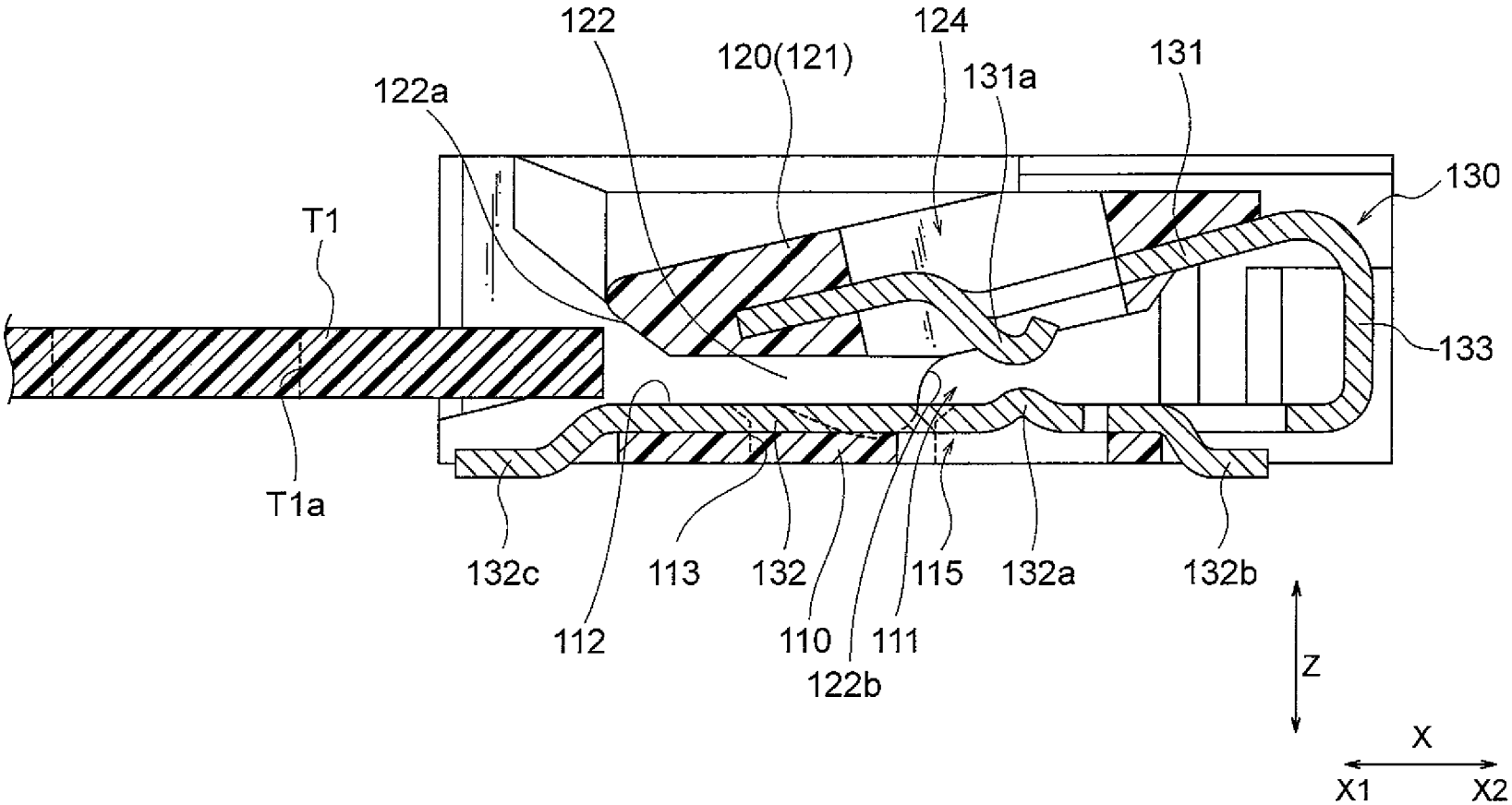
FIG. 4 is a cross-sectional view showing a state where a first board is not inserted into the board connector.

As shown in FIGS. 1 and 4, the housing 110 is integrally fixed to second beam portions 132 of the contacts 130 in the state where the second beam portions 132 are embedded in the housing 110. As shown in FIGS. 1 and 4, the housing 110 has a board receiving portion 111, a board placing surface 112, a pair of action point portion receiving portions 113, a pair of movement regulating portions 114, and a plurality of housing hole portions 115.

Figure 5:
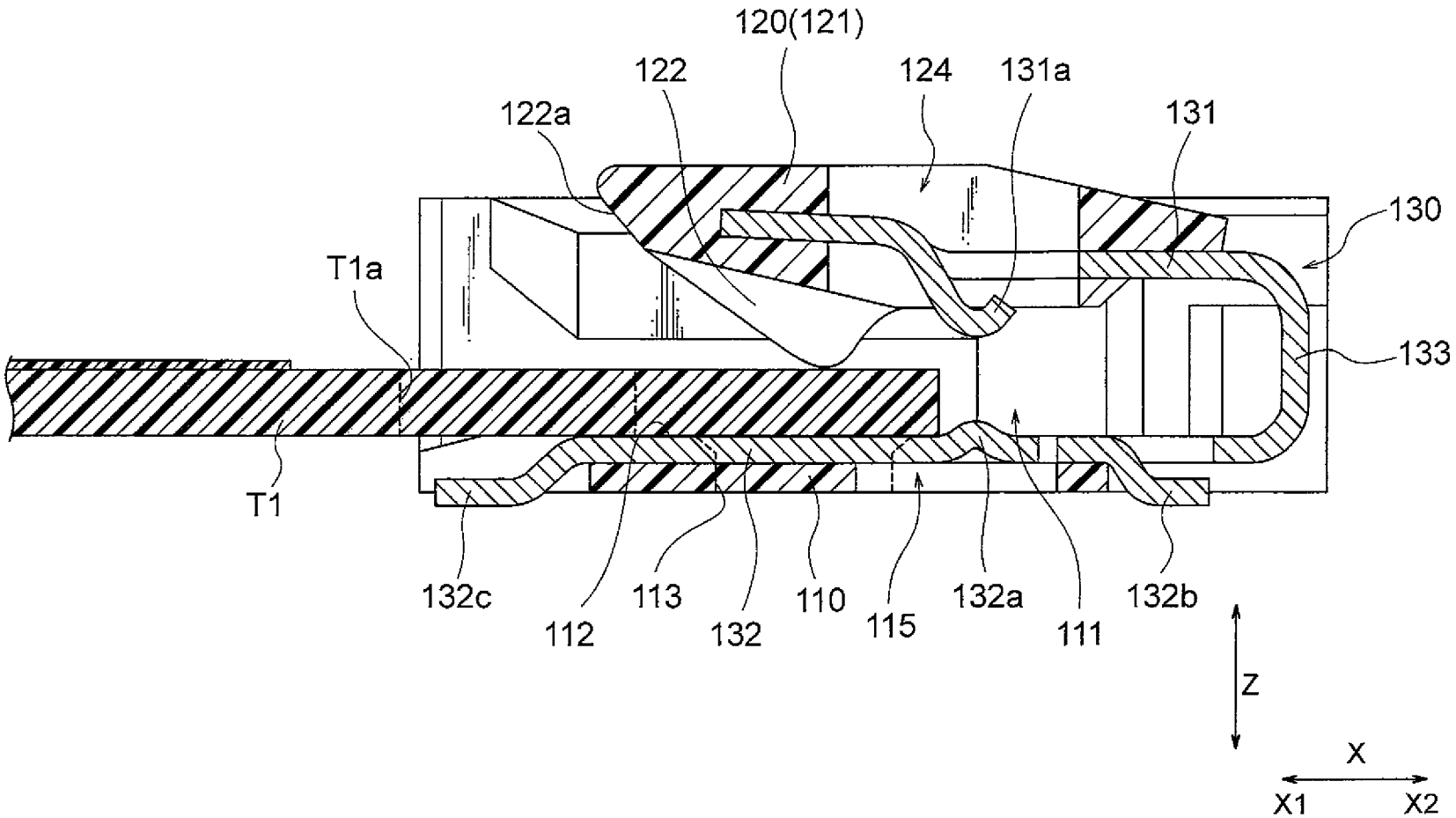
FIG. 5 is a cross-sectional view showing a state where the first board is on the way of insertion into or removal from the board connector.

As shown in FIGS. 4 and 5, the board receiving portion 111 is a space formed jointly by the housing 110 and the actuator 120 and adapted to receive therein the first board T1 at the time of insertion of the first board T1 into the board connector 100.

As shown in FIGS. 4 and 5, the board placing surface 112 is an upper surface, facing the actuator 120 side, of a bottom plate of the housing 110 and serves as a placing surface for the first board T1 at the time of insertion of the first board T1 into the board connector 100.

As shown in FIG. 4, the action point portion receiving portions 113 are formed in the bottom plate of the housing 110 for receiving therein action point portions 122 of the actuator 120, respectively.

As shown in FIG. 1, the movement regulating portions 114 are formed in both side walls, in a contact arrangement direction Y perpendicular to a board insertion direction X, of the housing 110 and respectively faces protruding portions 123 of the actuator 120 from a rear side X1 in the board insertion direction X. When bending the contacts 130 in the manufacture of the board connector 100, the movement regulating portions 114 serve as marks for relative positioning between the actuator 120 and the housing 110 cooperatively with the protruding portions 123 of the actuator 120. Further, after the manufacture of the board connector 100, even if the first board T1 is caught by the actuator 120 when removing the first board T1 from the board connector 100, the movement regulating portions 114 engage with the protruding portions 123 of the actuator 120 to inhibit movement of the actuator 120 toward the rear side X1 in the board insertion direction X, thereby preventing deformation of the contacts 130 which is otherwise caused by the movement of the actuator 120.

As shown in FIGS. 1 and 4, the housing hole portions 115 are portions formed in the housing 110 for allowing elastic displacement of second clipping portions 132*a* of the contacts 130, respectively, and are also holes that are formed as a result of preventing movement of the second beam portions 132 using a mold when the housing 110 and the second beam portions 132 are integrally molded together.

As shown in FIGS. 1 and 4, the actuator 120 has a body portion 121, the pair of action point portions 122, the pair of protruding portions 123, and a plurality of actuator hole portions 124.

As shown in FIGS. 1 and 4, the body portion 121 is integrally fixed to first beam portions 131 of the contacts 130 in the state where the first beam portions 131 are embedded in the body portion 121. The body portion 121 is not pivotally supported by the peripheral member/members such as the housing 110 or the contacts 130.

As shown in FIGS. 1 and 4, the action point portions 122 are respectively provided at two positions on both sides, in the contact arrangement direction Y, of the body portion 121 on the rear side X1, in the board insertion direction X, of the body portion 121. The action point portions 122 protrude from the body portion 121 toward the board placing surface 112 side and are located in the board receiving portion 111. In other words, the action point portions 122 are respectively disposed at positions which are pushed by the first board T1 at the time of insertion of the first board T1 into the board connector 100. As shown in FIG. 4, each action point portion 122 is disposed more on the rear side X1 in the board insertion direction X than first and second clipping portions 131*a* and 132*a* of the contact 130. As shown in FIG. 4, each action point portion 122 has, on the rear side X1 in the board insertion direction X, an inclined surface 122*a* which is inclined so as to approach the board placing surface 112 toward a front side X2 in the board insertion direction X. By forming this inclined surface 122*a*, each action point portion 122 can be easily pushed upward with a small insertion force of the first board T1.

As shown in FIG. 1, the protruding portions 123 protrude outward, in the contact arrangement direction Y, from both sides, in the contact arrangement direction Y, of the body portion 121 and respectively face the movement regulating portions 114 of the housing 110 from the front side X2 in the board insertion direction X. While the protruding portions 123 of the actuator 120 are used as portions whose movement toward the rear side X1 in the board insertion direction X is regulated by the movement regulating portions 114 of the housing 110, the specific configuration of such a portion is not limited thereto.

As shown in FIG. 1, the actuator hole portions 124 are portions formed in the actuator 120 for allowing elastic displacement of the first clipping portions 131*a* of the contacts 130, respectively, and are also holes that are formed as a result of preventing movement of the first beam portions 131 using a mold when the actuator 120 and the first beam portions 131 are integrally molded together.

As shown in FIG. 4, each contact 130 is of the normally closed type, i.e. the distance between the first and second clipping portions 131*a* and 132*a* is set smaller than the thickness of the first board T1 in the state where the first board T1 is not inserted.

Figure 3:
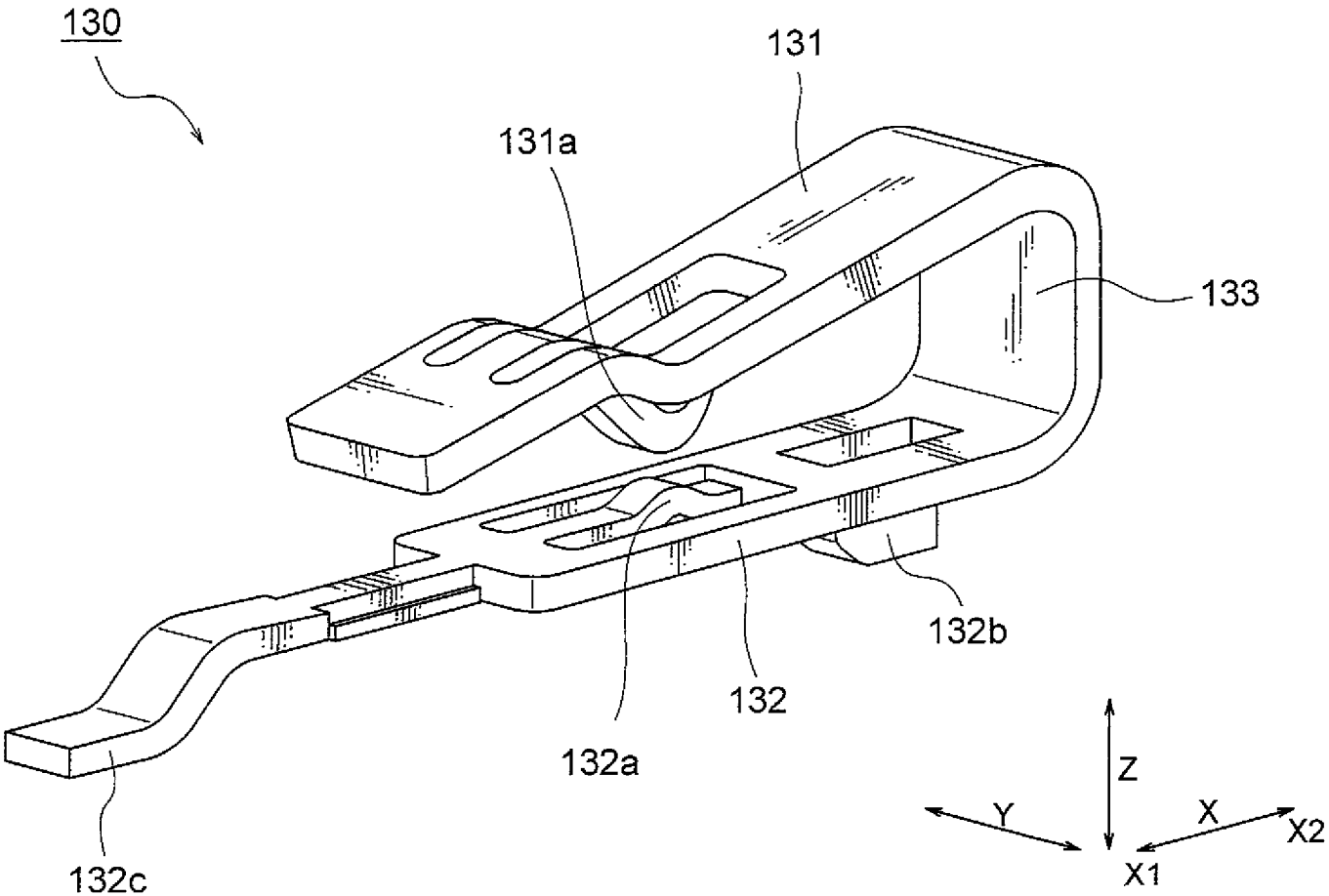
FIG. 3 is a perspective view showing a contact in the first embodiment.

As shown in FIGS. 3 and 4, each contact 130 has the first beam portion 131, the second beam portion 132, and a connecting portion 133 which are integral and continuous with each other.

As shown in FIGS. 1 and 4, the first beam portion 131 is for the most part embedded in the body portion 121 of the actuator 120 and is integrally fixed to the body portion 121.

As shown in FIGS. 1 and 4, the first beam portion 131 has the first clipping portion 131*a* exposed to the board receiving portion 111.

The first clipping portion 131*a* serves as a contact point with a corresponding one of pads T1*b* formed on a surface of the first board T1.

As shown in FIGS. 1, 3, and 4, the first clipping portion 131*a* is supported like a cantilever by the first beam portion 131. Accordingly, the first clipping portion 131*a* is configured to be elastically displaceable independently of the actuator 120 and the first beam portion 131 in a direction away from the second clipping portion 132*a*.

The first clipping portion 131*a* faces the second clipping portion 132*a*.

As described above, the first clipping portion 131*a* and the second clipping portion 132*a* face each other, i.e. the position of the first clipping portion 131*a* and the position of the second clipping portion 132*a* in the board insertion direction X coincide with each other. Alternatively, the position of the first clipping portion 131*a* and the position of the second clipping portion 132*a* in the board insertion direction X may be offset from each other.

While the first clipping portion 131*a* extends from the first beam portion 131 toward the front side X2 in the board insertion direction X, the extending direction of the first clipping portion 131*a* is not limited thereto. For example, the first clipping portion 131*a* may be configured to extend from the first beam portion 131 toward the rear side X1 in the board insertion direction X so as to be supported like a cantilever by the first beam portion 131.

As shown in FIGS. 1 and 4, the second beam portion 132 is for the most part embedded in the housing 110 and is integrally fixed to the housing 110.

As shown in FIGS. 1 and 4, the second beam portion 132 has the second clipping portion 132*a* exposed to the board receiving portion 111, a first terminal portion 132*b* which is formed more on the front side X2 in the board insertion direction X than the second clipping portion 132*a* and is soldered to the second board T2, and a second terminal portion 132*c* which is formed more on the rear side X1 in the board insertion direction X than the second clipping portion 132*a* and is soldered to the second board T2.

As shown in FIGS. 1, 3, and 4, the second clipping portion 132*a* is supported like a cantilever by the second beam portion 132. Accordingly, the second clipping portion 132*a* is configured to be elastically displaceable independently of the housing 110 and the second beam portion 132 in a direction away from the first clipping portion 131*a*.

While the second clipping portion 132*a* extends from the second beam portion 132 toward the front side X2 in the board insertion direction X, the extending direction of the second clipping portion 132*a* is not limited thereto. For example, the second clipping portion 132*a* may be configured to extend from the second beam portion 132 toward the rear side X1 in the board insertion direction X so as to be supported like a cantilever by the second beam portion 132.

As shown in FIGS. 1 and 4, the connecting portion 133 connects between an end, on the front side X2 in the board insertion direction X, of the first beam portion 131 and an end, on the front side X2 in the board insertion direction X, of the second beam portion 132. The connecting portion 133 biases the first beam portion 131 and the second beam portion 132 so as to cause the first clipping portion 131*a* and the second clipping portion 132*a* to approach each other. In other words, the connecting portion 133 produces a clipping force between the first clipping portion 131*a* and the second clipping portion 132*a*. As shown in FIG. 4, the distance between the connecting portion 133 and the action point portion 122 of the actuator 120 is set longer than the distance between the connecting portion 133 and the first clipping portion 131*a*. This can reduce an insertion force required for the first board T1 to thereby improve the workability and can prevent excessive physical contact between the first board T1 and the action point portion 122 of the actuator 120 at the time of insertion of the first board T1 to thereby prevent damage to the first board T1. As shown in FIG. 2, the connecting portions 133 of the contacts 130 are arranged in parallel with each other in the contact arrangement direction Y in the state where the positions of the connecting portions 133 are aligned in the board insertion direction X and in a connector thickness direction Z, and accordingly, root portions of the first beam portions 131

(boundary portions between the first beam portions 131 and the connecting portions 133) each movable like a cantilever at the time of insertion of the first board T1 are also arranged in parallel with each other in the contact arrangement direction Y in the state where the positions of the root portions are aligned in the board insertion direction X and in the connector thickness direction Z. The connector thickness direction Z is perpendicular to the board insertion direction X and the contact arrangement direction Y.

As shown in FIG. 1, the first board T1 has action point portion receiving portions T1*a* which are respectively formed at two positions on both sides, in the contact arrangement direction Y, of the first board T1 and are adapted to respectively receive therein the action point portions 122 of the actuator 120, and further has the pads T1*b* adapted to be connected to the first clipping portions 131*a* of the contacts 130, respectively.

While the pads T1*b* and conductor patterns are formed only on the surface, facing the first clipping portions 131*a*, of the first board T1, pads and conductor patterns may be formed also on the back surface side of the first board T1. In this case, the second clipping portions 132*a* are also used as contact points with the first board T1.

A hold-down (not illustrated) of the board connector 100 may be soldered to the second board T2.

With this hold-down, the housing 110 and the second board T2 are fixed together firmly.

Hereinbelow, a method of manufacturing the board connector 100 will be described.

First, the contacts 130 with the connecting portions 133 not being bent are prepared and arranged in parallel with each other.

Then, in the state where the contacts 130 are placed in a mold, the actuator 120 and the housing 110 are insert-molded, so that the actuator 120 and the first beam portions 131 of the contacts 130 are integrally molded together and that the housing 110 and the second beam portions 132 of the contacts 130 are integrally molded together. When molding the actuator 120 and the housing 110, it is necessary to prevent movement of the first beam portions 131 and, as a result, the actuator hole portions 124 are formed in the actuator 120 as shown in FIG. 1, while it is necessary to prevent movement of the second beam portions 132 and, as a result, the housing hole portions 115 are formed in the housing 110 as shown in FIG. 1.

Then, finally, the contacts 130 are bent at the connecting portions 133, respectively.

In this event, the movement regulating portions 114 of the housing 110 and the protruding portions 123 of the actuator 120 serve as marks for relative positioning between the actuator 120 and the housing 110 and the contacts 130 are bent so that the protruding portions 123 are located on the front side X2 in the board insertion direction X of the movement regulating portions 114. This makes it possible to achieve accurate bending of the contacts 130. Further, the action point portions 122 of the actuator 120 and the action point portion receiving portions 113 of the housing 110 also serve as marks at the time of bending the contacts 130.

Hereinbelow, a method of attaching the first board T1 to the board connector 100 and the operations of the respective components at the time of attaching the first board T1 will be described with reference to FIGS. 4 to 6.

First, as shown in FIGS. 4 and 5, a worker inserts the first board T1 between the housing 110 and the actuator 120 from the rear side X1 toward the front side X2 in the board insertion direction X.

In this event, since the action point portions 122 of the actuator 120 each have the inclined surface 122*a* which is inclined so as to approach the board placing surface 112 toward the front side X2 in the board insertion direction X, the action point portions 122 of the actuator 120 are pushed upward in a direction away from the board placing surface 112 by the insertion of the first board T1 as shown in FIG. 5.

In this event, as shown in FIG. 5, the first beam portions 131 integral with the actuator 120 are pushed upward along with the actuator 120 in the direction away from the board placing surface 112. In this event, the connecting portions 133 are elastically deformed, so that the first beam portions 131 are each moved like a cantilever.

As a result, as shown in FIG. 5, the distance between the first and second clipping portions 131*a* and 132*a* is increased so as to be greater than the thickness of the first board T1.

Then, the first board T1 further pushed toward the front side X2 in the board insertion direction X by the worker enters between the first and second clipping portions 131*a* and 132*a*.

Figure 6:
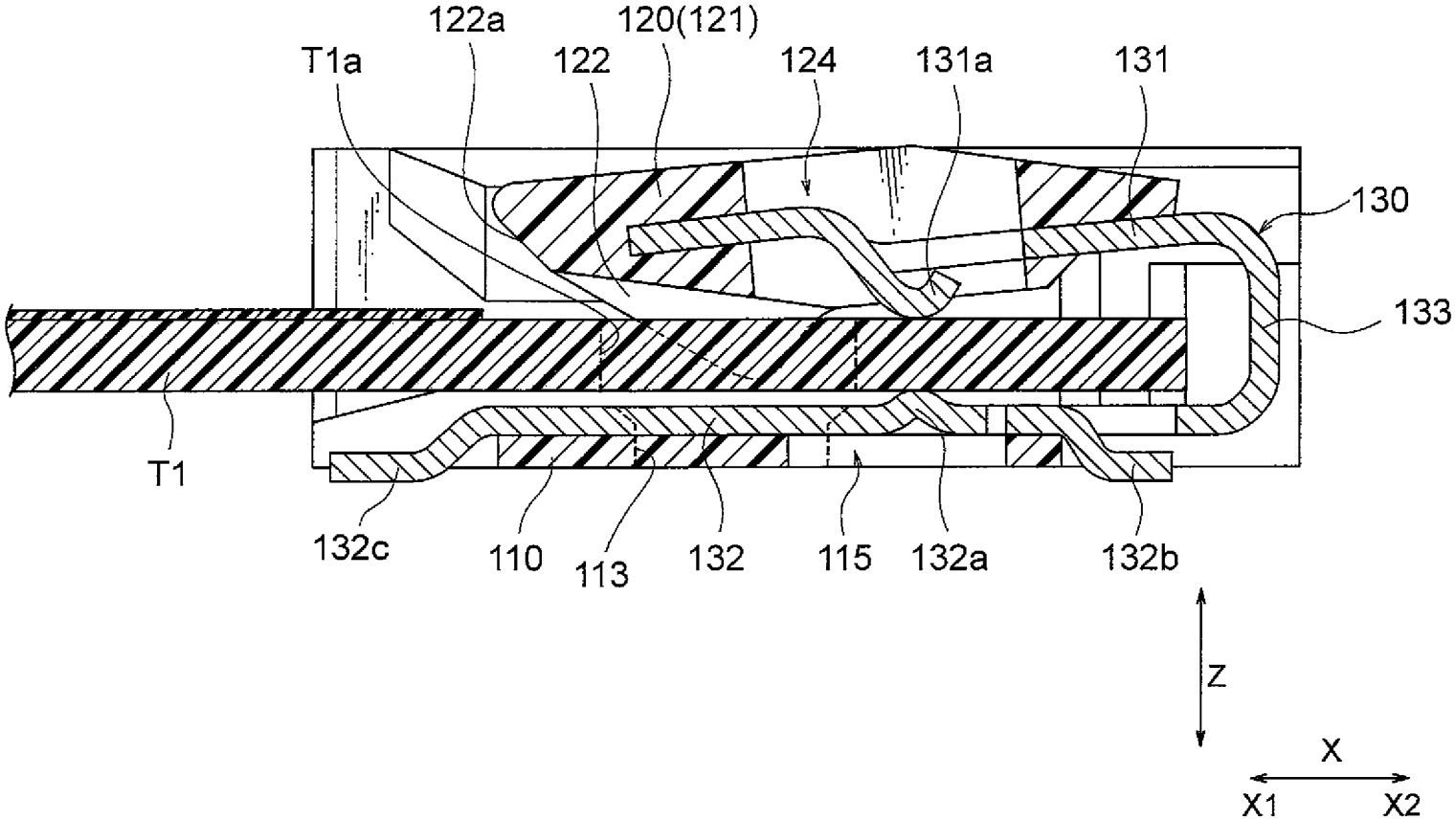
FIG. 6 is a cross-sectional view showing a state where the first board is inserted deepest into the board connector.

Then, the first board T1 is further pushed toward the front side X2 in the board insertion direction X by the worker and, as shown in FIG. 6, the position of each action point portion receiving portion T1*a* of the first board T1 coincides with the position of the action point portion 122 of the actuator 120.

In this event, since the action point portions 122 of the actuator 120 lose the support by the first board T1, the connecting portions 133 are elastically restored to cause the actuator 120 to move in a direction in which the action point portions 122 approach the board placing surface 112 side.

As a result, as shown in FIG. 6, the distance between the first and second clipping portions 131*a* and 132*a* of each contact 130 attempts to return to the normal distance, i.e. attempts to be smaller than the thickness of the first board T1.

Accordingly, the first and second clipping portions 131*a* and 132*a* of the contacts 130 clip the first board T1 therebetween, so that connection between the first clipping portions 131*a* and the pads T1*b* of the first board T1 is established. In this event, since the first clipping portions 131*a* and the second clipping portions 132*a* are provided elastically displaceable independently of the actuator 120 and the housing 110, respectively, even if variation exists in the thickness of the first board T1 or in the distances between the first and second clipping portions 131*a* and 132*a* of the contacts 130, such variation can be absorbed by the elasticity of the first and second clipping portions 131*a* and 132*a* of the contacts 130, thereby improving the contact reliability between the board connector 100 and the first board T1.

Simultaneously, the action point portions 122 of the actuator 120 are respectively received in the action point portion receiving portions T1*a* of the first board T1.

As a consequence, the first board T1 is positioned with respect to the board connector 100 and is prevented from coming off the board connector 100.

Hereinbelow, a method of detaching the first board T1 from the board connector 100 will be described with reference to FIGS. 4 to 6.

Removal of the first board T1 from the board connector 100 is achieved by a single operation of strongly pulling out the first board T1 from the board connector 100 toward the rear side X1 in the board insertion direction X. The operations of the respective components of the board connector 100 at the time of the removal of the first board T1 are as follows.

When the worker starts to strongly pull out the first board T1 from the board connector 100 toward the rear side X1 in the board insertion direction X, first, edge portions of the action point portion receiving portions T1*a* of the first board T1 respectively abut against locking surfaces 122*b* of the action point portions 122 of the actuator 120, so that the actuator 120 is pushed upward in the direction away from the board placing surface 112.

In this event, as shown in FIG. 5, the first beam portions 131 integral with the actuator 120 are pushed upward along with the actuator 120 in the direction away from the board placing surface 112. In this event, the connecting portions 133 are elastically deformed, so that the first beam portions 131 are each moved like a cantilever.

As a result, the distance between the first and second clipping portions 131*a* and 132*a* is increased so as to be greater than the thickness of the first board T1. Accordingly, the worker can easily pull out the first board T1 from between the first and second clipping portions 131*a* and 132*a*.

Even if the first board T1 engages with (is caught by) the locking surfaces 122*b* of the action point portions 122 at the time of pulling out the first board T1, the protruding portions 123 abut against the movement regulating portions 114 to prevent the actuator 120 from moving toward the rear side X1 in the board insertion direction X along with the first board T1 and therefore it is possible to prevent deformation of the contacts 130 which is otherwise caused by the movement of the actuator 120.

Since the board connector 100 thus obtained is configured to increase the distance between the first and second clipping portions 131*a* and 132*a* of the contacts 130 using the first board T1 inserted into the board connector 100, the operation of the actuator 120 is not required apart from the insertion operation of the first board T1. Therefore, it is possible to achieve the attaching operation of the first board T1 by the single operation of inserting the first board T1 and thus to extremely reduce the operation load for the attaching operation of the first board T1.

Further, since the distance between the first and second clipping portions 131*a* and 132*a* is automatically increased by a certain required amount by the insertion of the first board T1, even if the first board T1 is manufactured to be thicker in a tolerance range, it is possible to avoid excessive sliding between the first board T1 and the first and second clipping portions 131*a* and 132*a*, thereby preventing damage to the first board T1.

Further, since the board connector 100 is configured to move the actuator 120 by the insertion of the first board T1 without manually operating the actuator 120, the moving amount of the actuator 120 at the time of the insertion of the first board T1 is limited to a degree that allows the first board T1 to be inserted between the first and second clipping portions 131*a* and 132*a* and an excessive force as in a case of manual operation of the actuator 120 is prevented from being applied to the actuator 120 and so on, so that it is possible to prevent damage to the actuator 120 and so on.

Further, since manual operation of the actuator 120 is not required, even if the entire board connector 100 is designed to be small, it is possible to avoid a situation where it is difficult to manually operate the actuator 120 with fingers of a normal worker, so that the attaching operation of the first board T1 can be easily achieved.

Further, since the actuator 120 and the first beam portions 131 are integrally fixed together, the movement of the actuator 120 and the movement of the first beam portions 131 at the time of the insertion of the first board T1 can be completely integral with each other, so that it is possible to avoid sliding between the actuator 120 and the first beam portions 131 at the time of the insertion of the first board T1, thus to prevent the generation of abrasion powder due to the sliding to thereby avoid adhesion of abrasion powder to the contacts 130 and the first board T1, and thus to ensure the contact reliability of the board connector 100.

The first clipping portions 131*a* are provided elastically displaceable independently of the actuator 120 and the first beam portions 131, while the second clipping portions 132*a* are provided elastically displaceable independently of the housing 110 and the second beam portions 132.

Accordingly, even if variation exists in the thickness of the first board T1 or in the distances between the first and second clipping portions 131*a* and 132*a* of the contacts 130, such variation can be absorbed by the elasticity of the first and second clipping portions 131*a* and 132*a* of the contacts 130. As a consequence, it is possible to prevent degradation of the contact reliability between the board connector 100 and the first board T1 due to insufficient contact between the first clipping portions 131*a* and the first board T1 or to prevent damage to the first board T1 due to excessive sliding contact between the first and second clipping portions 131*a* and 132*a* and the first board T1.

The actuator 120 and the contacts 130 are integrally molded together, while the housing 110 and the contacts 130 are integrally molded together.

Accordingly, the operation of attaching the contacts 130 to the actuator 120 and the housing 110 is not required and the contacts 130, the actuator 120, and the housing 110 can be handled as a single member, so that the manufacturing load can be reduced. Further, since it is possible to avoid disengagement between the actuator 120 and the contacts 130 and disengagement between the housing 110 and the contacts 130, the product reliability can be improved.

The clipping force between the first and second clipping portions 131*a* and 132*a* is produced by the connecting portion 133 which is formed by bending a metal material.

Accordingly, not only the structure of the contact 130 is simplified, but also the board connector 100 can be manufactured only by bending the contacts 130 after the actuator 120 and the housing 110 are integrally molded with the contacts 130, so that the manufacturing load of the board connector 100 can be extremely reduced.

As a linkage mechanism for linking between the pushed movement of the action point portions 122 due to the insertion of the first board T1 and the increase in distance between the first and second clipping portions 131*a* and 132*a*, use is made of the simple structure in which the actuator 120 and the first beam portions 131 of the contacts 130 are integrated together. Accordingly, it is possible to suppress the occurrence of operation failure of the board connector 100 due to failure of the linkage mechanism.

Since the actuator 120 and the first beam portions 131 of the contacts 130 are integrally fixed together, it is possible to maintain accurate linkage between the actuator 120 and the first beam portions 131. Accordingly, the distance between the first and second clipping portions 131*a* and 132*a* which increases by the insertion of the first board T1 can be maintained constant. As a consequence, it is possible to avoid sliding between the first board T1 and the first and second clipping portions 131*a* and 132*a* to thereby reliably prevent damage to the first board T1 and it is also possible to improve the contact reliability between the board connector 100 and the first board T1.

The housing 110 and the first board T1 respectively have the action point portion receiving portions 113 and T1*a* for receiving therein the action point portion 122 of the actuator 120.

Accordingly, the thickness of the entire board connector 100 can be reduced and, since the first board T1 is positioned with respect to the board connector 100 and is prevented from coming off the board connector 100, it is possible to reliably maintain connection between the pads T1*b* of the first board T1 and the first clipping portions 131*a* of the contacts 130.

Since the connecting portion 133 biases the first and second beam portions 131 and 132 so as to cause the first and second clipping portions 131*a* and 132*a* to approach each other, it is possible to prevent the actuator 120 from unexpectedly moving to rise with respect to the housing 110 before or after attaching the first board T1.

Second Embodiment

Figure 7:
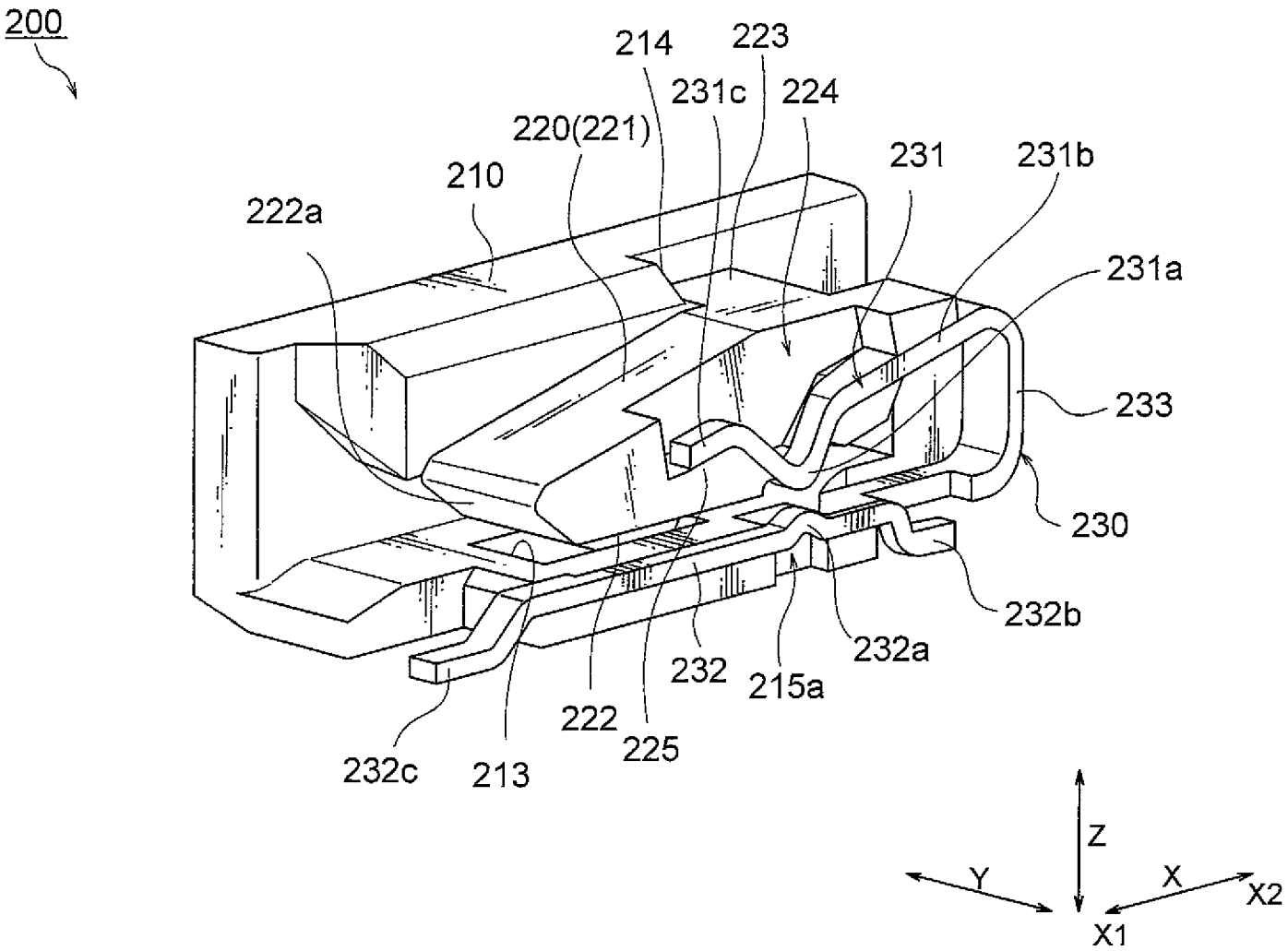
FIG. 7 is a perspective view, partly broken away, showing a board connector according to a second embodiment of this invention.
Figure 8:
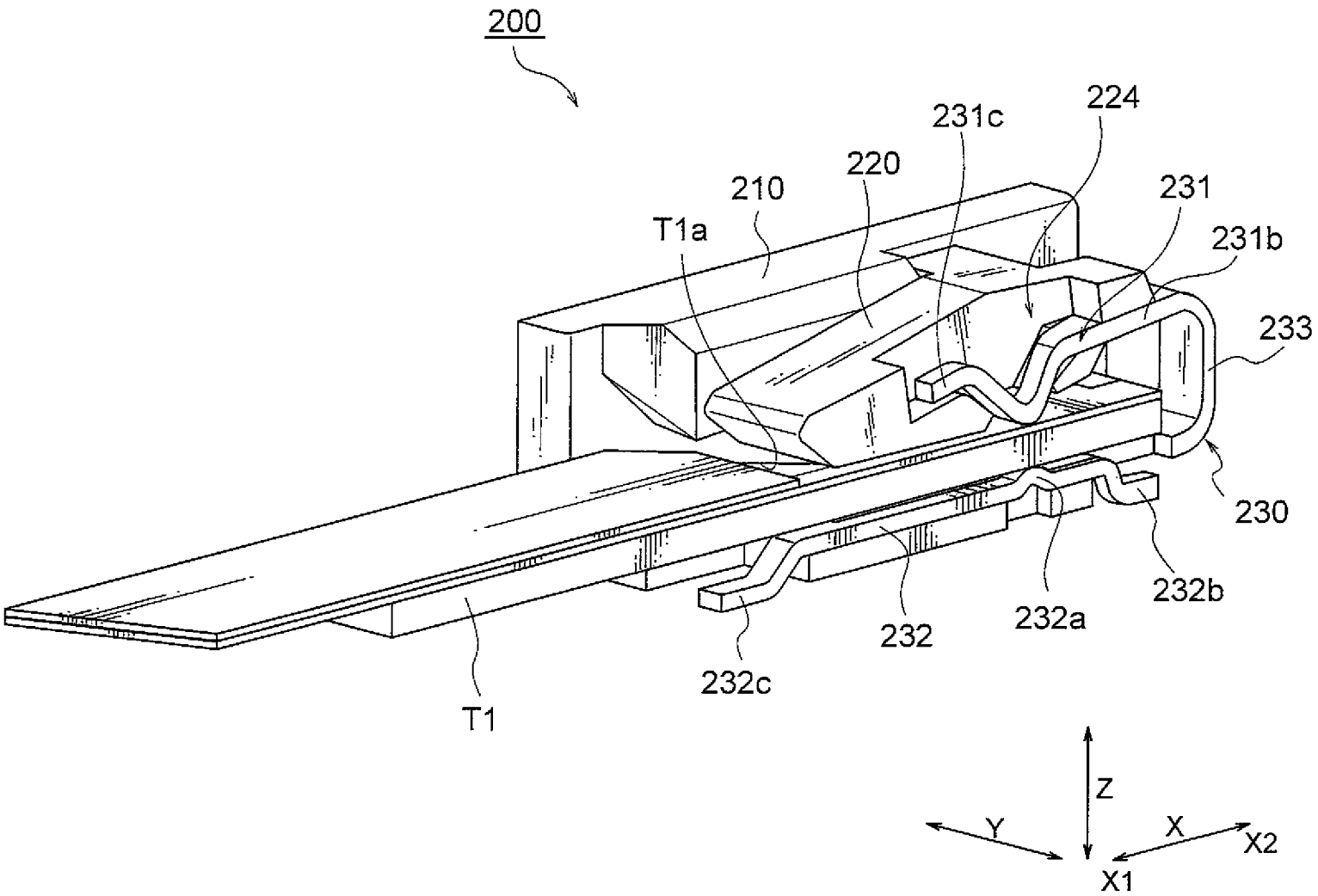
FIG. 8 is a perspective view, partly broken away, showing a state where a first board is inserted deepest into the board connector according to the second embodiment.
Figure 9:
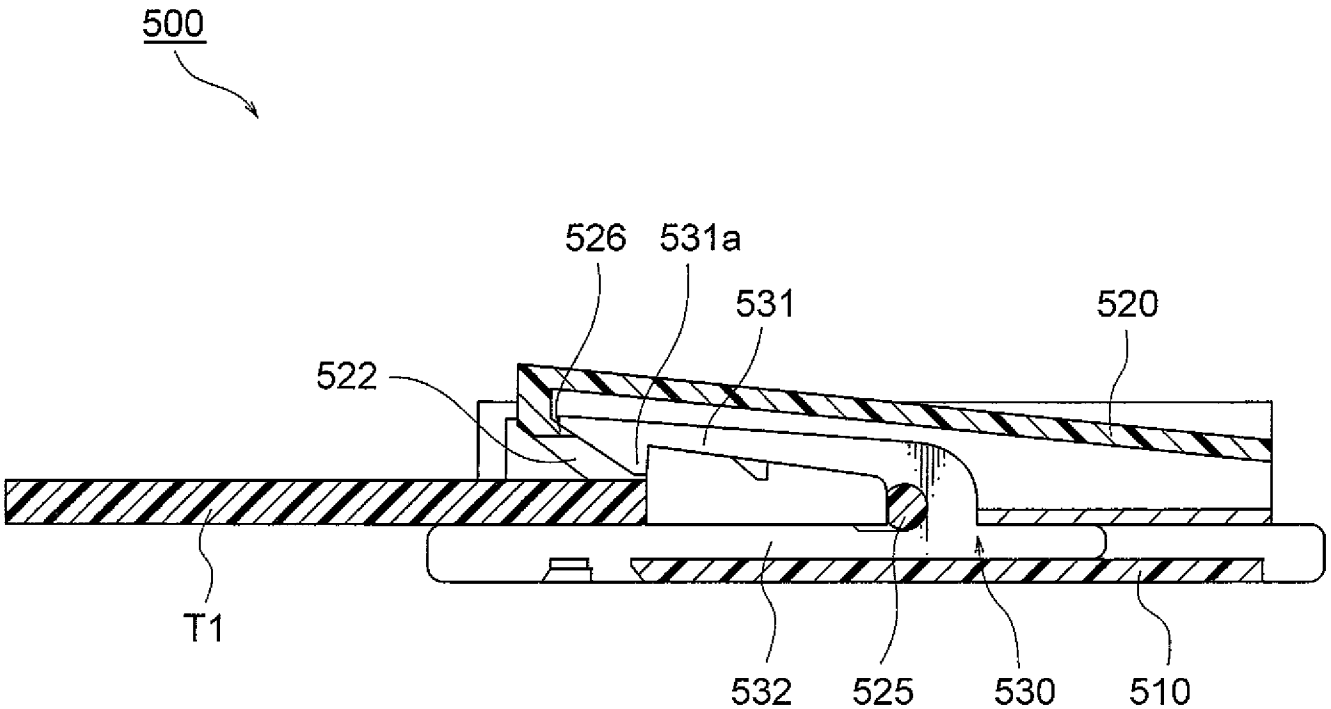
FIG. 9 is a cross-sectional view showing a conventional electrical connector.

Now, a board connector 200 according to a second embodiment of this invention will be described with reference to FIGS. 7 and 8.

Since the basic structure and operation of the board connector 200 are the same as those of the above-mentioned first embodiment, explanation will be omitted except for differences between the first and second embodiments by replacing reference numerals on the order of 100 shown in the description and FIGS. 1 to 6 relating to the board connector 100 of the first embodiment with reference numerals on the order of 200.

In the first embodiment, both the first and second clipping portions 131*a* and 132*a* have the elasticity which is independent of the actuator 120 and the housing 110, respectively. On the other hand, in the second embodiment, only a first clipping portion 231*a* of each contact 230 has the elasticity which is independent of an actuator 220.

Further, in the first embodiment, the first clipping portion 131*a* is configured to be supported like a cantilever by the first beam portion 131 so as to be elastically displaceable independently of the first beam portion 131 and the actuator 120.

However, in the second embodiment, a specific structure for giving the independent elasticity to the first clipping portion 231*a* is different from that in the first embodiment. Specifically, as shown in FIG. 7, a first beam portion 231 of the contact 230 has a fixed portion 231*b* which is formed more on the front side X2 in the board insertion direction X than the first clipping portion 231*a* and is fixed to the actuator 220, and an abutting portion 231*c* which is formed more on the rear side X1 in the board insertion direction X than the first clipping portion 231*a* and is disposed in abutment with a to-be-abutted portion 225 of the actuator 220 or with a gap therebetween, so that the movement of the abutting portion 231*c* toward the second clipping portion 232*a* side is regulated by the to-be-abutted portion 225. The to-be-abutted portion 225 and the abutting portion 231*c* may be omitted.

Accordingly, the first clipping portion 231*a* in the second embodiment is configured to be elastically displaceable independently of the actuator 220 in a direction away from the second clipping portion 232*a* in the connector thickness direction Z.

The structure for giving the independent elasticity to the first clipping portion 231*a* in the second embodiment may alternatively be applied to the second clipping portion 232*a*. In this case, a second beam portion 232 of the contact 230 may be formed with a fixed portion (not illustrated) which is formed more on the front side X2 in the board insertion direction X than the second clipping portion 232*a* and is fixed to a housing 210, and with an abutting portion (not illustrated) which is formed more on the rear side X1 in the board insertion direction X than the second clipping portion 232*a* and is disposed in abutment with a to-be-abutted portion (not illustrated) of the housing 210 or with a gap therebetween, so that the movement of the abutting portion (not illustrated) toward the first clipping portion 231*a* side is regulated by the to-be-abutted portion (not illustrated). As in the case of the first clipping portion 231*a*, the to-be-abutted portion (not illustrated) and the abutting portion (not illustrated) may be omitted.

In the above-mentioned embodiments, the description has been given assuming that the first board is FPC (Flexible Printed Circuit). However, it may be any plate-like connection object such as FFC (Flexible Flat Cable).

In the above-mentioned embodiments, the description has been given assuming that the first clipping portion of each contact serves as a contact point with the first board. However, the second clipping portion may alternatively be used as a contact point with the first board or both the first and second clipping portions may be used as contact points with the first board. Further, apart from the first and second clipping portions, a contact point with the first board may be formed in at least one of the first and second beam portions.

The description has been given assuming that both the first and second clipping portions have the independent elasticity in the first embodiment, while only the first clipping portion has the independent elasticity in the second embodiment. Alternatively, only the second clipping portion may have the independent elasticity.

The independent elasticity giving structure described in the first embodiment and the independent elasticity giving structure described in the second embodiment may be combined and used.

In the above-mentioned embodiments, the description has been given assuming that the actuator is not pivotally supported by the peripheral member/members such as the housing or the contacts. However, the actuator may be pivotally supported by the peripheral member/members such as the housing or the contacts. In this case, in order to ensure smooth movability of the actuator, the positions of root portions of the first beam portions each movable like a cantilever at the time of insertion of the first board and the position of a pivot axis of the actuator are adjusted with each other so that, specifically, those positions coincide with each other or are close to each other in the board insertion direction X and in the connector thickness direction Z.

In the above-mentioned embodiments, all the contacts have the same shape. However, a plurality of contacts having different shapes may be combined and used. In this case, in order to ensure smooth movability of the actuator even when the actuator and first beam portions of the contacts are integrally fixed together, the contacts are arranged in parallel with each other in the contact arrangement direction Y in the state where the positions of root portions of the first beam portions (near boundaries between the first beam portions and connecting portions) each movable like a cantilever at the time of insertion of the first board coincide with each other or are close to each other in the board insertion direction X and in the connector thickness direction Z.

In the above-mentioned embodiments, the actuator and the first beam portions are integrally fixed together by integrally molding the actuator and the first beam portions together. However, the specific fixing configuration is not limited thereto. For example, the actuator and the first beam portions may be integrally fixed together by bonding the actuator and the first beam portions together or fitting (press-fitting) the actuator and the first beam portions together.

In the above-mentioned embodiments, the housing and the second beam portions are integrally fixed together by integrally molding the housing and the second beam portions together. However, the specific fixing configuration is not limited thereto. For example, the housing and the second beam portions may be integrally fixed together by bonding the housing and the second beam portions together or fitting (press-fitting) the housing and the second beam portions together.

What is claimed is:

1. A board connector comprising:

a contact comprising a first and a second clipping portion for clipping therebetween a board which is inserted from the outside, a first beam portion supporting the first clipping portion, and a second beam portion supporting the second clipping portion;

a housing that supports the contact; and an actuator that is fixed to the first beam portion, wherein the actuator has an action point portion that is formed more on a rear side in a board insertion direction than the first and second clipping portions and that is pushed by the board at the time of insertion of the board, and the first clipping portion is elastically displaceable independently of the actuator in a direction away from the second clipping portion.

2. The board connector according to claim 1, wherein the second beam portion is held by the housing, and the second clipping portion is elastically displaceable independently of the housing in a direction away from the first clipping portion.

3. The board connector according to claim 1, wherein the contact has a connecting portion that connects between the first beam portion and the second beam portion.

4. The board connector according to claim 1, wherein a plurality of contacts are provided and are arranged in parallel with each other in a direction perpendicular to the board insertion direction.

5. The board connector according to claim 1, wherein the first clipping portion is elastically displaceable independently of the first beam portion.

6. The board connector according to claim 5, wherein the first clipping portion is supported like a cantilever by the first beam portion.

7. The board connector according to claim 1, wherein the first beam portion has a fixed portion which is formed more on a front side in the board insertion direction than the first clipping portion and is fixed to the actuator.

8. The board connector according to claim 7, wherein the first beam portion has an abutting portion which is formed more on the rear side in the board insertion direction than the first clipping portion and whose movement toward the second clipping portion side is regulated by abutment against a to-be-abutted portion of the actuator.

9. The board connector according to claim 1, wherein the second clipping portion is elastically displaceable independently of the second beam portion.

10. The board connector according to claim 9, wherein the second clipping portion is supported like a cantilever by the second beam portion.

11. The board connector according to claim 1, wherein the second beam portion has a fixed portion which is formed more on a front side in the board insertion direction than the second clipping portion and is fixed to the housing.

12. the board connector according to claim 11, wherein the second beam portion has an abutting portion which is formed more on the rear side in the board insertion direction than the second clipping portion and whose movement toward the first clipping portion side is regulated by abutment against a to-be-abutted portion of the housing.

13. A board connector comprising:

a contact comprising a first and a second clipping portion for clipping therebetween a board which is inserted from the outside, a first beam portion supporting the first clipping portion, and a second beam portion supporting the second clipping portion;

a housing that supports the second beam portion; and an actuator that is fixed to the first beam portion, wherein the actuator has an action point portion that is formed more on a rear side in a board insertion direction than the first and second clipping portions and that is pushed by the board at the time of insertion of the board, and the second clipping portion is elastically displaceable independently of the housing in a direction away from the first clipping portion.

* * * * *